US007604028B2

(12) United States Patent
Bridgefarmer

(10) Patent No.: US 7,604,028 B2
(45) Date of Patent: Oct. 20, 2009

(54) FRONT POCKET WALLET

(76) Inventor: Donnie R. Bridgefarmer, P.O. Box 2994, McKinney, TX (US) 75070

( * ) Notice: Subject to any disclaimer, the term of this patent is extended or adjusted under 35 U.S.C. 154(b) by 183 days.

(21) Appl. No.: 11/493,136

(22) Filed: Jul. 27, 2006

(65) Prior Publication Data

US 2008/0023114 A1 Jan. 31, 2008

(51) Int. Cl.
*A45C 11/18* (2006.01)

(52) U.S. Cl. ..... 150/147; 150/131; 150/145; 206/39

(58) Field of Classification Search ..... 150/147, 150/148.149, 131, 132, 145; 206/39, 38
See application file for complete search history.

(56) References Cited

U.S. PATENT DOCUMENTS 1,791,703 A * 2/1931 Benedict et al. ..... 150/147
3,360,027 A * 12/1967 Price ..... 150/132
3,856,063 A * 12/1974 Dengel ..... 150/132
4,942,913 A * 7/1990 Musso ..... 150/138
5,222,764 A * 6/1993 Dyer ..... 281/45
5,275,217 A * 1/1994 Eakin ..... 150/132
5,370,419 A * 12/1994 Takayama ..... 281/31
5,506,395 A * 4/1996 Eppley ..... 235/486
6,110,551 A * 8/2000 Exline et al. ..... 428/40.1
D435,340 S * 12/2000 Kojoori ..... D3/250
6,619,349 B2 * 9/2003 Gribovsky ..... 150/135
6,648,038 B2 * 11/2003 Vetter ..... 150/147
6,886,283 B2 * 5/2005 Arraut ..... 40/661
2004/0216825 A1 * 11/2004 Radochonski ..... 150/106
2007/0284264 A1 * 12/2007 Davis ..... 206/39

* cited by examiner

*Primary Examiner*—Sue A Weaver

(57) ABSTRACT

A wallet comprising a plurality of rectangular panels layered and coupled so as to provide three vertically oriented pockets and one horizontally oriented pocket, the first and second vertically oriented pockets dimensioned to accept credit cards and a third vertically oriented pocket dimensioned to accept an identification card or driver's license. The wallet is made of a resilient material, such as a leather, leather-like, denim, khaki or vinyl material.

12 Claims, 7 Drawing Sheets

FRONT POCKET WALLET

TECHNICAL FIELD

This invention relates to wallets, and more particularly, to a wallet configured to retain items in a plurality of pockets, said pocket wallet adapted to be received by a money band.

BACKGROUND OF THE INVENTION

Conventional bi-fold and tri-fold wallets are primarily designed to hold currency, namely a plurality of bills, credit cards, driver's license, photographs and business cards. However, the use of hard currency has been reduced and replaced by the use of credit cards. Although the function of the wallet has changed, the size, shape and configuration of the conventional wallet has stayed the same. Conventional wallets, which are thick and unwieldy, are designed to be carried in a back pocket.

What is desired is a wallet adapted to carry a number of items, such as credit cards, and currency when used in combination with a money band, such as that described in U.S. patent application Ser. No. 11/118,924 by Bridgefarmer, the contents of which are incorporated by reference into this application. Such a wallet could hold a number of credit cards in a compact configuration while allowing quick and simple access to the cards retained in the wallet, as well as a driver's license. These would be held in a "thin" configuration adapted to be carried in, for example, a front pocket of pants, a shirt and the like. It is an object of the present invention to provide such a wallet alone, and also in combination with a money band.

SUMMARY OF THE INVENTION

The present invention comprises a front pocket wallet, alone and in combination with a money band. In one aspect, the present invention is a wallet for retaining a plurality of cards, and an identification card, such as driver license, in an interior pocket having a transparent face. In a second embodiment of the present invention, such front pocket wallet of the present invention can be used to hold a shortened writing utensil such as a pencil, and a small pad of paper. In a third embodiment of the present invention, the front pocket wallet can be hinged along a longitudinal axis and in a fourth embodiment of the present invention, the front pocket wallet can be hinged along a lateral axis.

The first and second embodiments of the front pocket wallet are each comprised of several rectangular panels of a fashionable, resilient material such as leather, leather-like, denim, khaki or vinyl material, the panels being layered and then coupled, e.g., sewn, together along three (3) perimeters, each coupled pair of panels forming a separate interior pocket having a lateral opening running along either a lateral or longitudinal length of the wallet case. The openings lead to a plurality of interior compartments of the front pocket wallet for retaining, among other things, credit cards and the like. The front pocket wallet is adapted to be received within the money band. The interior pockets of the present invention are configured to hold cards in a substantially vertical orientation. In another aspect, the present invention is a front pocket wallet in combination with a money band. The third and fourth embodiments of the front pocket wallet are also each comprised of several rectangular panels of a fashionable, resilient material such as leather, leather-like, denim, khaki or vinyl material, the panels being layered and then coupled, e.g., sewn, together along three (3) perimeters, provided that in one set of such panels are coupled along a longitudinal axis and lateral axis, respectively, to form a hinge.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

For a better understanding of the present invention including the features, advantages and specific embodiments, reference is made to the following detailed description along with accompanying drawings in which.

References in the detailed description correspond to like references in the Figures unless otherwise noted. Like numerals refer to like parts throughout the various Figures.

DETAILED DESCRIPTION OF A PREFERRED EMBODIMENT

While the making and using of a preferred embodiment of the present invention is discussed in detail below, it should be appreciated that the present invention provides many applicable inventive concepts which can be embodied in a wide variety of specific contexts. Some features of the preferred embodiment shown and discussed may be simplified or exaggerated for illustrating the principles of the invention.

Figure 1:
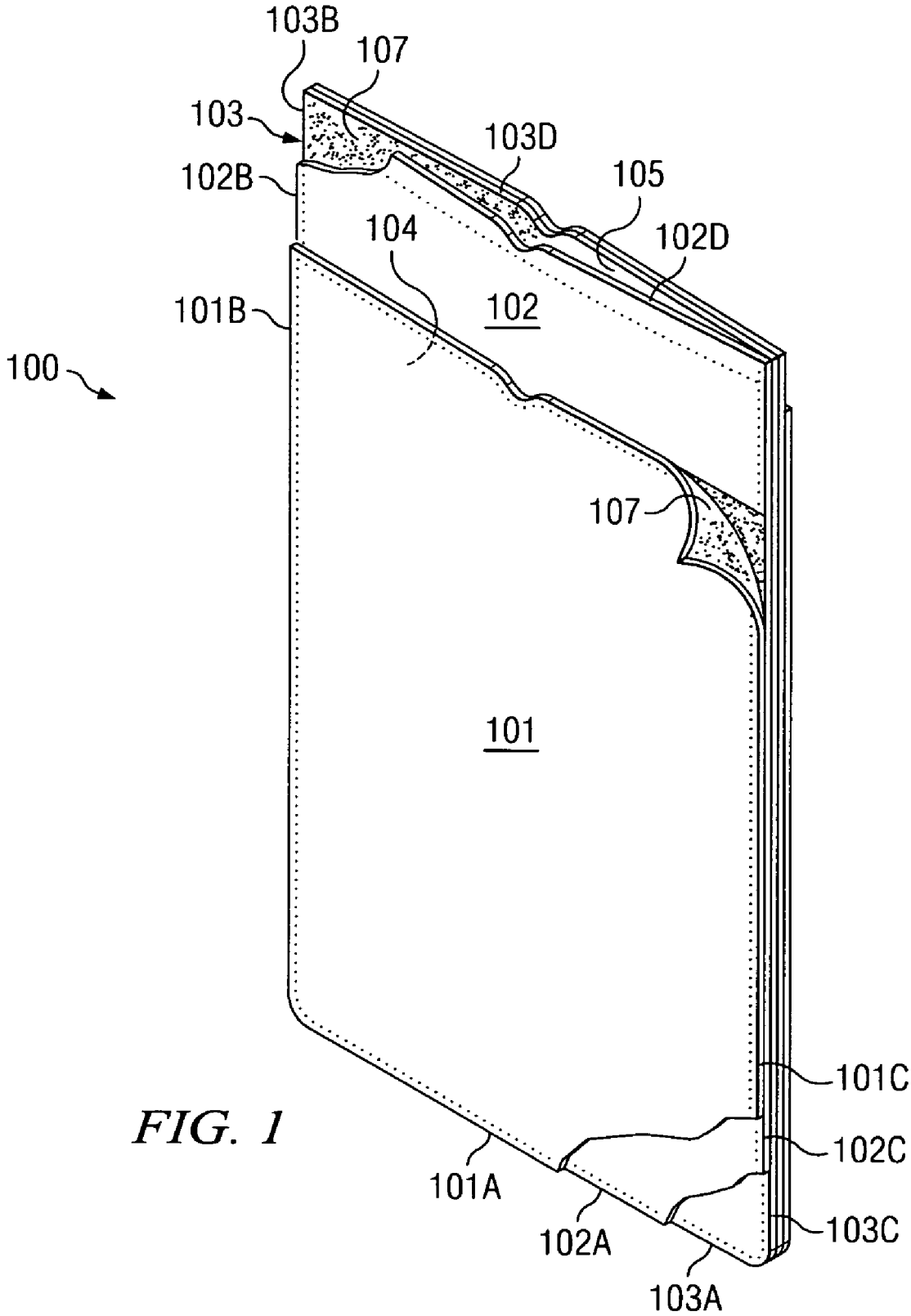
FIG. 1 is a view of the front side of a front pocket wallet in a first embodiment of the present invention.

Referring now to FIG. 1, a view of the front side of a front pocket wallet 100 in a first embodiment of the present invention is provided. Front pocket wallet 100 is substantially constructed of 5 rectangular panels of a resilient material such as leather, coupled, e.g., sewn, along 3 outer diameters thereof, and a sixth member comprising a transparent panel. More specifically, front pocket wallet has a first panel 101, a second panel 102 and a third panel 103 are seen on the front side. The dimensions of first panel 101 are about 2⅞ inches along the longitudinal axis and about 2⅞ inches along a lateral axis. The dimensions of the second and third panels 102, and 103 are about 3¾ inches along the longitudinal axis and 2⅞ inches along the lateral axis. The bottom edges 101A, 102A and 103A of first panel 101, second panel 102 and third panel 103 respectively are aligned with one another. The left side edges 101B, 102B and 0103B and right side edges 101C, 102C and 103C of first panel 101, second panel 102 and third panel 103C, respectively, are also substantially aligned. The edges 101A, 101B, and 101C are coupled, for example, sewn, to edges 102A, 102B and 102C, and 103A, 103B and 103C respectively. The coupling of the first panel 101, the second panel 102 and third panel 103 along three edges operate to form a first and second vertically oriented interior pockets 104 and 105. First and second vertically oriented interior pockets 104 and 105 can be lined with a soft material 107.

Figure 2:
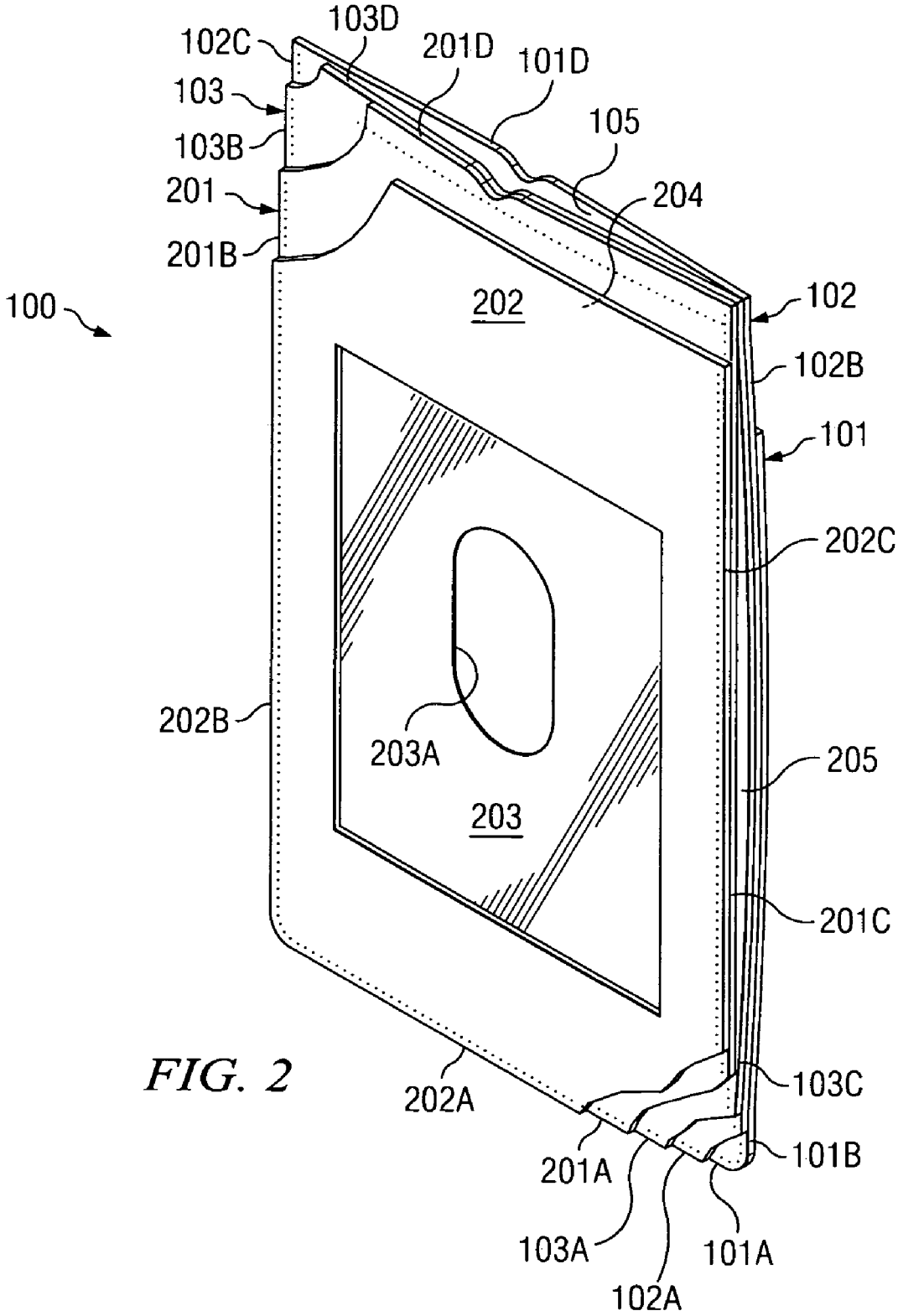
FIG. 2 is a view of the back side of the front pocket wallet in the first embodiment of the present invention.

Now referring to FIG. 2 a view of the back side of a front pocket wallet 100 in a first embodiment of the present invention is provided. As seen therein, front pocket wallet has a fourth panel 201 and a fifth panel 202 seen on the back side (also seen is third panel 103). The dimensions of fourth panel 201 are about 3¾ inches along the longitudinal axis and about 2⅞ inches along a lateral axis. Panel 201 and panel 102 can comprise a single piece of material (e.g., leather), folded such that they are opposed to each other. For purposes of this invention, any plurality of panels that are to be coupled can comprise a single piece of material that is folded to create a structure similar to sewn panels. The dimensions of fifth panel 202 are about 3 9/16 inches along the longitudinal axis and 2⅞ inches along the lateral axis. Fifth panel 202 is further formed having a rectangular aperture in the approximate center thereof, a transparent panel 203 having dimensions of about 2½ inches along the longitudinal axis and about 2 inches along the lateral axis thereof, covering said aperture. The bottom edges 103A, 201A and 202A of third panel 103, fourth panel 201 and fifth panel 202 respectively are aligned with one another. The left side edges 103C (as seen from the opposite side), 201B and 202B and right side edges 103B, 201C and 202C of third panel 103, fourth panel 201 and fifth panel 202, respectively, are also substantially aligned. The edges 201A, 201B, and 201C are coupled, for example, sewn, to edges 202A, 202B and 202C, respectively. In addition, the edges 103A and 103C are coupled to the aligned edges of 201A and 202B, and the top edges 201D and 103D are coupled to each other. Edge 103B is not coupled to edges 201C/202C so that a first horizontally oriented interior pocket 205 is formed. The coupling of the fourth panel 201 and the fifth panel 202 along three edges operate to form a third vertically oriented interior pocket 204. An interior portion of third vertically oriented interior pocket 204 is visible through transparent panel 203. This third vertically oriented interior pocket 204 is particularly suited for receiving an identification card or driver license. Transparent panel 203 further has an oval shape cut 203A operable to allow the identification card or driver license to be easily removed from second interior pocket 204.

Figure 3A:
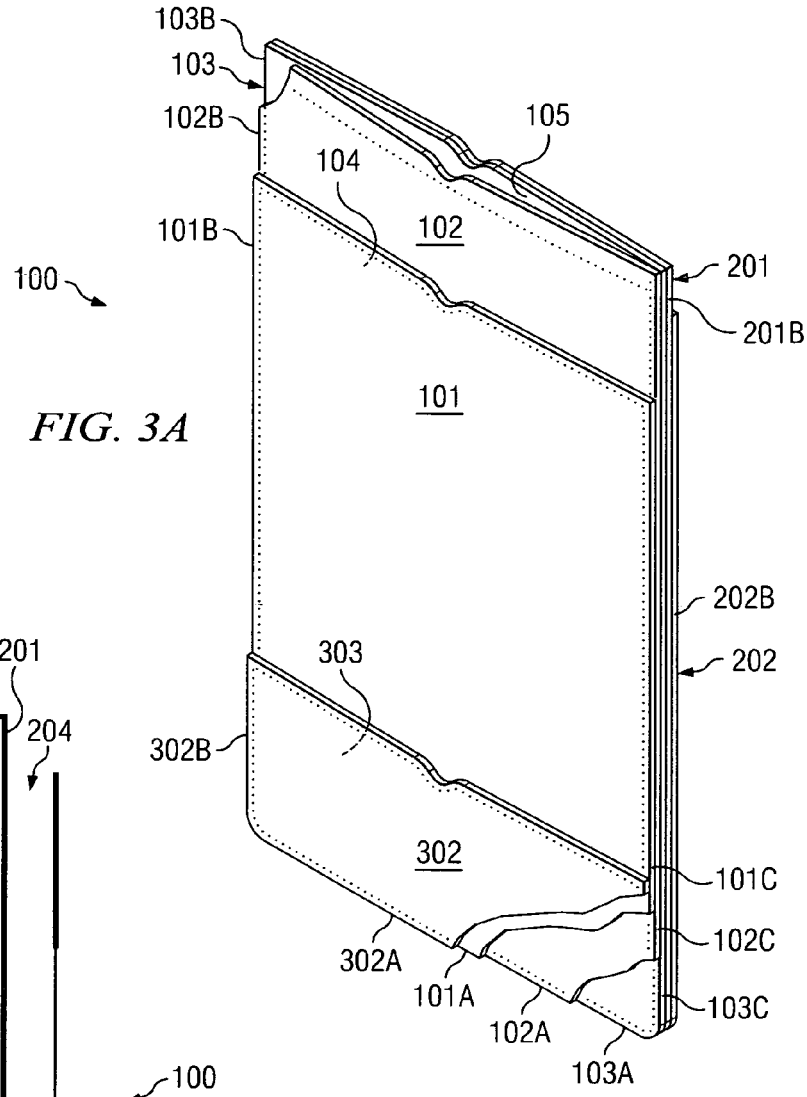
FIG. 3A is a front view of the front pocket wallet in a second embodiment of the present invention and FIG. 3B is a side view of the panels of the second embodiment of the present invention.
Figure 3B:
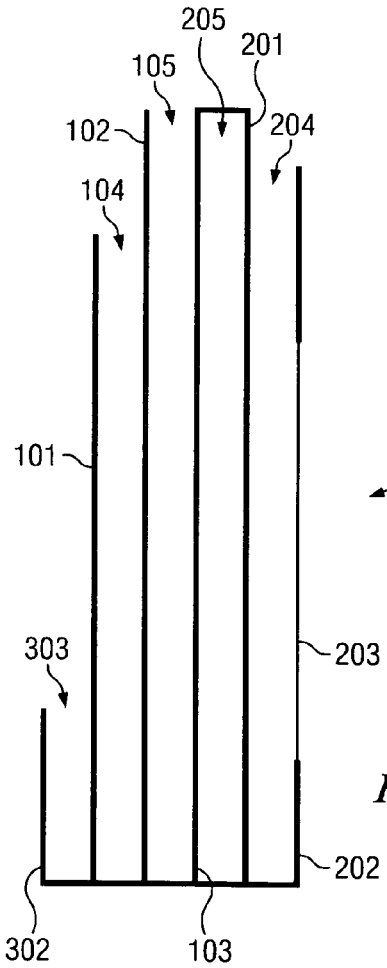

FIG. 3A is a front view of the front pocket wallet in a second embodiment of the present invention. As seen therein, a sixth panel 302 coupled to first panel 101 along the side edges, including 302B, and bottom edge 302A, forming fourth vertically oriented pocket 303. Sixth panel 302 has dimensions of about 1 Y, inches along the longitudinal axis and about 2⅞ inches along the lateral axis, and is coupled to the front side of the front pocket wallet along the bottom edge so as to form fourth vertically oriented interior pocket 303, for holding, for example, a key or coins. FIG. 3B is an exaggerated side view of all six panels (and the transparent panel) 302, 101, 102, 103, 201, 202, and 203 of the second embodiment of the present invention, showing each vertical pocket 303, 104, 105, and 204 and horizontal pocket 205. The first embodiment of the present invention is similar, provided that pocket 303 formed by panels 302/101 is not included.

Figure 4A:
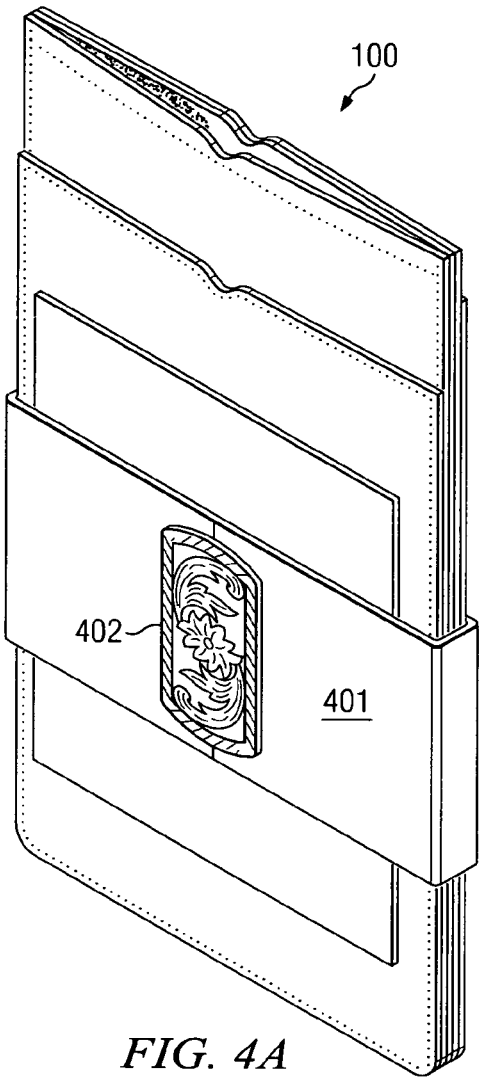
FIGS. 4A and 4B are views of the front side of a front pocket wallet in a first embodiment of the present invention in combination with a money band.
Figure 4B:
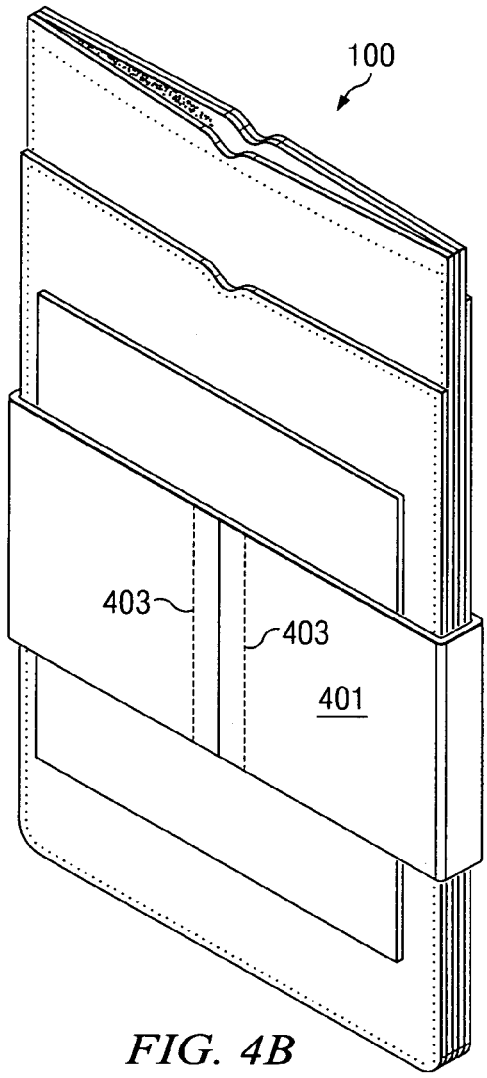

FIGS. 4A and 4B are views of the front side of a front pocket wallet in a first embodiment of the present invention in combination with a money band 401. Money band 401 comprises a band for holding folded currency, such band being made of a resilient material, such as leather or a leather-like material, having a first end and a second end, the band of which is looped and then fastened with a fastening means such as a conchoe 402 or sewn together 403 including with elastic.

Figure 5A:
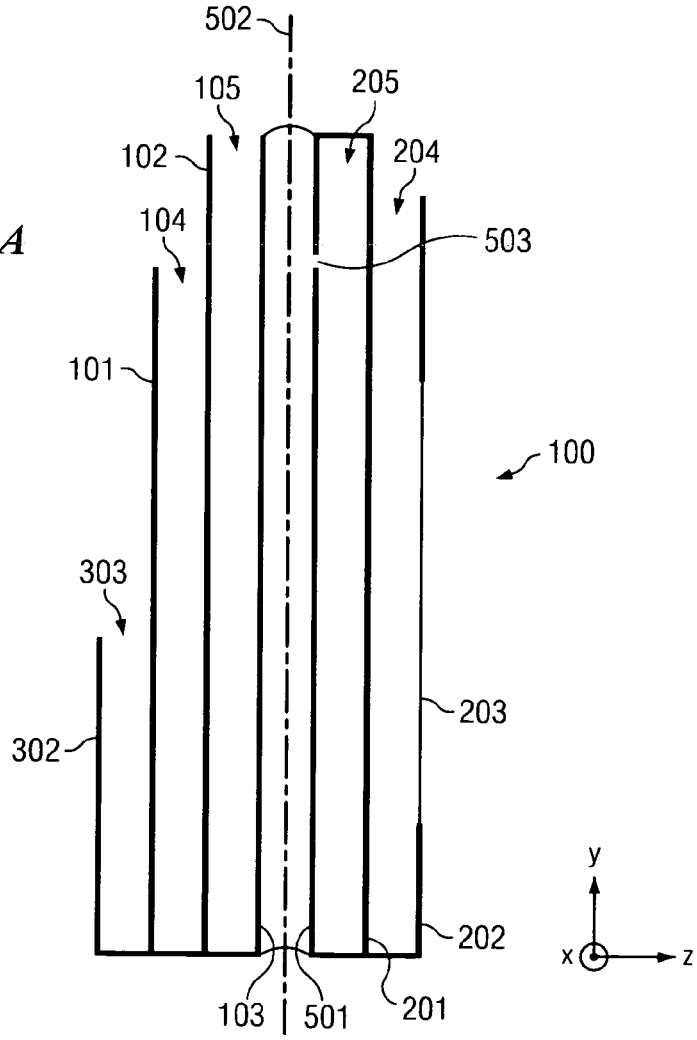
FIG. 5A is a view of the front pocket wallet in a third embodiment of the present invention having a longitudinal hinge.
Figure 5B:
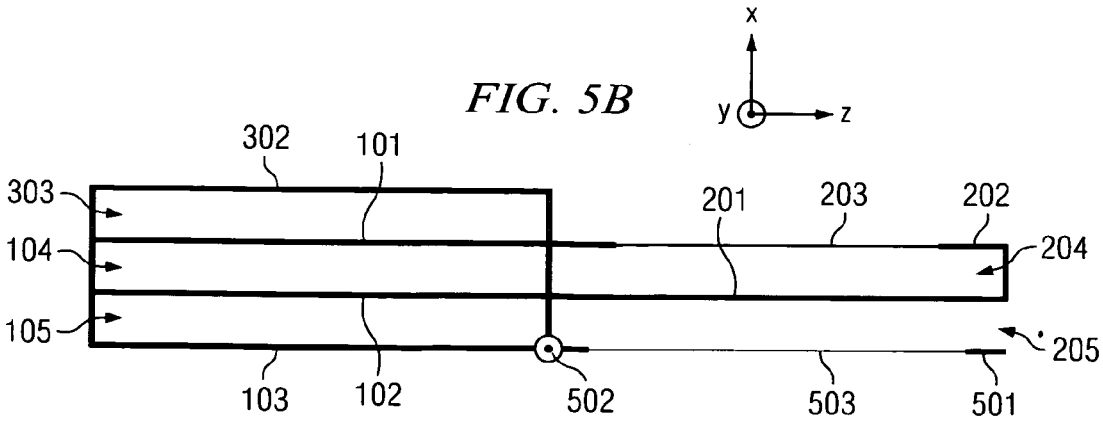
FIG. 5B is a top view of the third embodiment of the present invention.
Figure 5C:
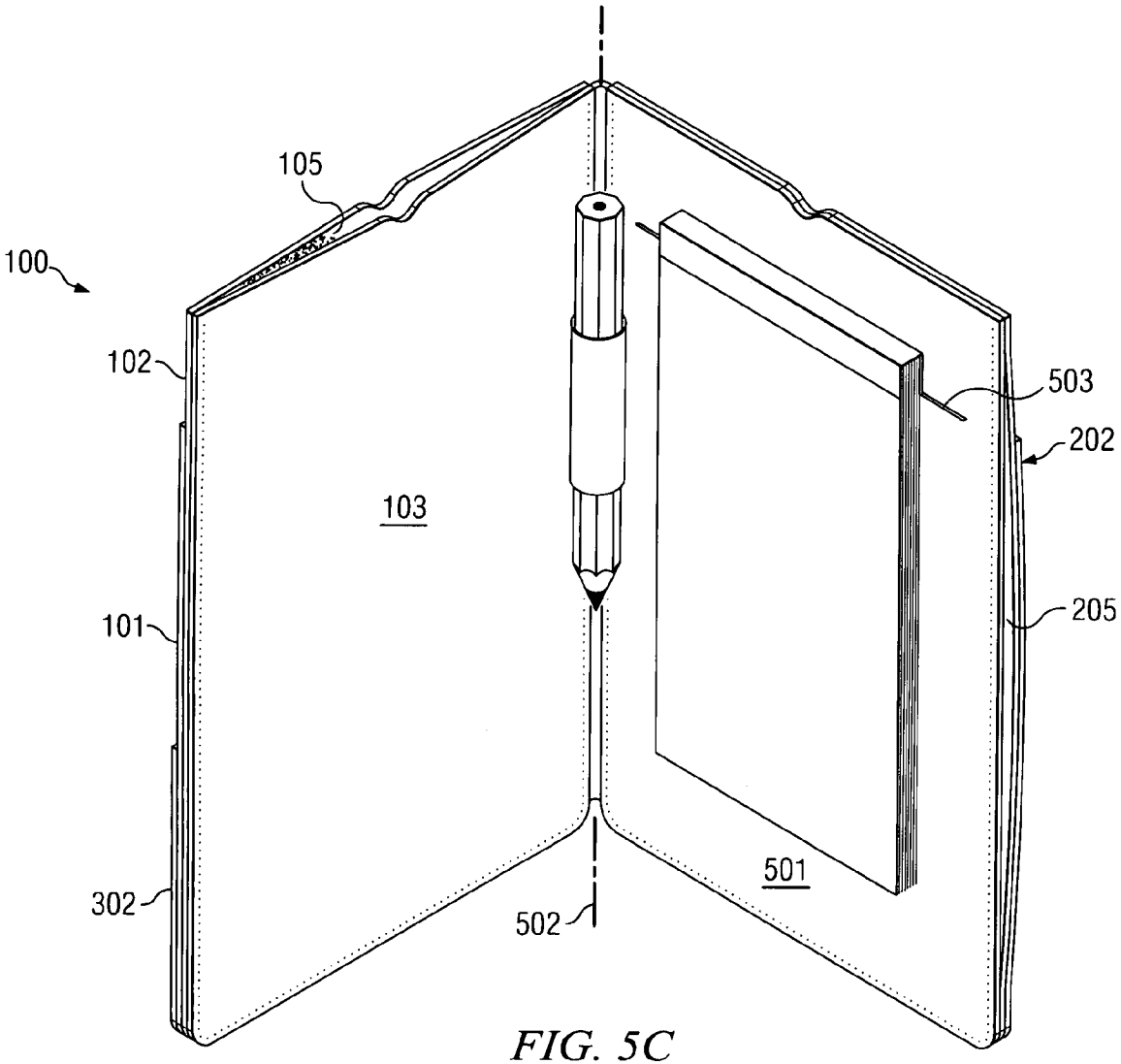
FIG. 5C is an inside view of the front pocket wallet.
Figure 6:
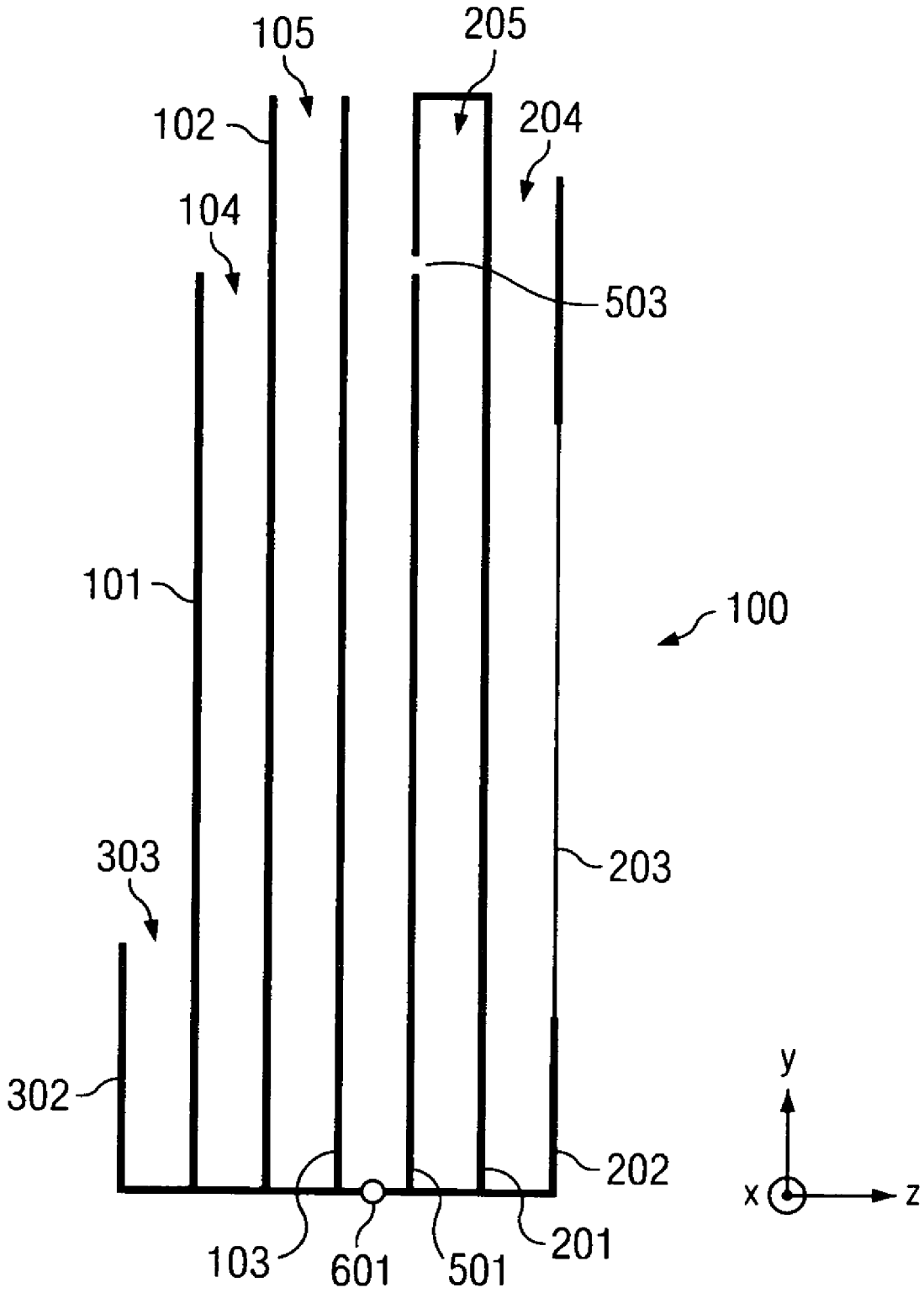
FIG. 6 is a view of the front pocket wallet in a fourth embodiment of the present invention having a lateral hinge.

FIG. 5A is an exaggerated side view (assuming FIGS. 1 and 2 show the invention along the x-y axis, FIG. 5A shows the invention y-z axis) of front pocket wallet in a third embodiment of the present invention, having an additional panel 501 so as to allow the wallet to have a longitudinal hinge 502. A slot 503 can be formed in panel 501 so as to permit insertion and storage of a small notepad. FIG. 5B shows a top view of the invention of FIG. 5A (along the x-z axis). FIG. 5C is a perspective view of the third embodiment of the present invention. FIG. 6 is an exaggerated side view of front pocket wallet in a fourth embodiment of the present invention having a lateral hinge 601.

The panels of the front pocket wallet are primarily constructed of a leather, simulated leather, denim, khaki, vinyl, plastic, canvas, corduroy, metals, and woven material. However, any material may be utilized which provides a support for retaining a plurality of cards such as credit cards. To accommodate conventional sizes of credit cards, the front pocket wallet is preferably sized as described above. However, it should be understood that any size of front pocket wallet maybe utilized and still be within the scope of the present invention.

The vertically oriented pockets 104, 105 and 204 are used to hold cards (e.g., credit cards, identification, etc.) within their interiors. It should be understood, that the size of the interior pockets and, hence, the wallet may be any size to accommodate the carriage of a plurality of cards or US or foreign currency.

With reference to FIGS. 1-6, the operation of the front pocket wallet 100 will now be explained. The front pocket wallet is utilized for the carriage of a plurality of cards, such as credit cards, driver's license, social security cards, grocery store cards and promotional cards. Cards may be positioned within the interior pockets 104, 105 and 204. The front pocket wallet is compact and provides a thin profile. The front pocket wallet enables a person to hold cards vertically in a side by side configuration. The front pocket wallet provides maximum visibility and ease of access of the cards, with a minimum of thickness of the front pocket wallet. With the front pocket wallet's thin profile, a person may comfortably position the front pocket wallet within the person's front pant or shirt pocket.

The embodiments shown and described above are only exemplary. Even though numerous characteristics and advantages of the present invention have been set forth in the foregoing description together with details of the invention, the disclosure is illustrative only and changes may be made within the principles of the invention to the full extent indicated by the broad general meaning of the terms used in the attached claims.

What is claimed is:

1. A wallet comprising:

a plurality of rectangular panels layered and coupled so as to provide at least three vertically oriented pockets and one horizontally oriented pocket, wherein the first and second vertically oriented pockets are dimensioned to accept credit cards and a third vertically oriented pocket dimensioned to accept an identification card or driver's license, the orientation of the vertically oriented pockets being parallel with the longest length of a side of the rectangular panel and the horizontally oriented pocket being parallel to the shortest length of a side of a rectangular panel, wherein the sides of the wallet correspond to the longest length of the rectangular panels and the top and bottom of the wallet correspond to the shortest length of the rectangular panels, the wallet further comprising:

a first panel;

a second panel, the first panel being coupled along the side edges and bottom edge to the second panel;

a third panel, the third panel being coupled along the side edges and bottom edges of the second panel;

a fourth panel, the fourth panel being coupled along one side edge and the bottom and top edges to the third panel; and a fifth panel, the fifth panel being coupled along the sides and bottom edges of the fourth panel;

the wallet in combination with a money band being made of a leather or a leather-like material, having a first end and a second end, the band of which is looped and then fastened with a fastening means forming a closed loop having open ends and being dimensioned to be inserted over the top or the bottom of the wallet.

2. The wallet of claim 1, being made of a resilient material.

3. The wallet of claim 2, wherein the material is one selected from the group consisting of leather, leather-like, denim, khaki, vinyl, plastic, canvas, corduroy, metals, and woven material.

4. The wallet of claim 1, further comprising a sixth panel being made of a substantially transparent material being located within a rectangular aperture of the fifth panel; said transparent panel having an aperture cut therein.

5. The wallet of claim 4, further comprising a seventh panel coupled along the side edges and bottom of the first panel forming a fourth vertically oriented pocket dimensioned to accept a key or coins.

6. The wallet of claim 1, wherein the dimensions of first panel are about 2⅞ inches along the longitudinal axis and about 2⅞ inches along a lateral axis; the dimensions of second and third panels being about 3¾ inches along the longitudinal axis and 2⅞ inches along the lateral axis; the dimensions of the fourth panel being about 3¾ inches along the longitudinal axis and about 2⅞ inches along a lateral axis and the dimensions of fifth panel being about 3⁹⁄₁₆ inches along the longitudinal axis and 2⅞ inches along the lateral axis.

7. The wallet of claim 1, wherein the interior pockets are lined with a soft material.

8. A wallet comprising a plurality of rectangular panels coupled so as to provide three vertically oriented pockets and a single horizontally oriented pocket, the first and second vertically oriented pockets dimensioned to accept credit cards and a third vertically oriented pocket dimensioned to accept an identification card or driver's license, the vertically oriented pockets being parallel with the longest length of a side of the rectangular panel and the horizontally oriented pocket being parallel with the shortest length of a side of a rectangular panel, wherein the sides of the wallet correspond to the longest length of the rectangular panels and the top and bottom of the wallet correspond to the shortest length of the rectangular panels, the wallet further comprising:

a first panel;

a second panel;

the first panel being coupled along the side edges and bottom edge to the second panel;

a third panel, the third panel being coupled along the side edges and bottom edge of the second panel;

a fourth panel, the fourth panel being coupled along one side edge and the top and bottom edges to the third panel; and a fifth panel, the fifth panel coupled along the side and bottom edges of the fourth panel; and the wallet in combination with a money band being made of a leather or a leather-like material, having a first end and a second end, the band of which is looped and then fastened with a fastening means forming a closed loop having open ends and being dimensioned to be inserted over the top or the bottom of the wallet.

9. The wallet of claim 8, made of a resilient material selected from the group consisting of leather, leather-like, denim, khaki and vinyl material.

10. The wallet of claim 8, further comprising a sixth panel being made of a substantially transparent material being located within a rectangular aperture of the fifth panel; said transparent panel having an aperture cut therein.

11. The wallet of claim 10, further comprising a seventh panel coupled along the side edges and bottom of the first panel forming a fourth vertically oriented pocket dimensioned to accept a key or coins.

12. The wallet of claim 8, wherein the dimensions of first panel are about 2⅞ inches along the longitudinal axis and about 2⅞ inches along a lateral axis; the dimensions of second panel being about 3¾ inches along the longitudinal axis and 2⅞ inches along the lateral axis; the dimensions of the third and fourth panels being about 3¾ inches along the longitudinal axis and about 2⅞ inch along a lateral axis and the dimensions of fifth panel being about 3⁹⁄₁₆ inches along the longitudinal axis and 2⅞ inches along the lateral axis.

* * * * *